United States Patent [19]

LaFleur, Jr. et al.

[11] 4,314,785

[45] Feb. 9, 1982

[54] STACKING AND PACKAGING APPARATUS

[75] Inventors: Paul J. LaFleur, Jr., Wilbraham; Francis C. Crescenzo, Springfield, both of Mass.

[73] Assignee: Package Machinery Company, East Longmeadow, Mass.

[21] Appl. No.: 107,175

[22] Filed: Dec. 26, 1979

[51] Int. Cl.[3] ..... B65G 57/30

[52] U.S. Cl. ..... 414/46; 414/94; 198/422; 53/533

[58] Field of Search ..... 414/42, 46, 94; 198/420, 422, 456, 482; 271/212; 53/171, 533, 541

[56] References Cited

U.S. PATENT DOCUMENTS

| | | | |
|---|---|---|---|
| 1,210,440 | 1/1917 | Elliott | 271/212 |
| 3,063,577 | 11/1962 | Shields | 414/94 X |
| 3,409,115 | 11/1968 | Porcaro | 198/456 |
| 3,675,792 | 7/1972 | Griner et al. | 414/46 |
| 3,712,487 | 1/1973 | Eberle | 414/94 |
| 4,108,319 | 8/1978 | Kacirek et al. | 414/94 |

FOREIGN PATENT DOCUMENTS 971882 10/1964 United Kingdom .

*Primary Examiner*—Robert W. Saifer

*Attorney, Agent, or Firm*—McCormick, Paulding & Huber

[57] ABSTRACT

Apparatus for forming a package containing rows of stacked articles includes a bottom loaded spiral stacker for successively elevating individual articles to be packed, an article conveyor for feeding successive articles to the stacker, a stacking conveyor above the stacker for accumulating stacks of articles formed by the stacker and moving the stacks away from the stacker, a separator conveyor which moves in parallel relation with the stacker conveyor and receives U-shaped separators or partitions, a first transfer mechanism for moving each successive formed stack from the stacking conveyor to the separator conveyor, and a second transfer mechanism for moving successive rows of stacked articles from the separator conveyor to a carton set-up station. The spiral stacker operates in timed relation with the stacking conveyor which operates intermittently to move each successive stack formed by the spiral stacker in a direction away from the spiral stacker.

23 Claims, 9 Drawing Figures

STACKING AND PACKAGING APPARATUS

BACKGROUND OF THE INVENTION

This invention relates in general to packaging apparatus and deals more particularly with improved apparatus for forming a package containing rows of stacked articles. The apparatus of the present invention is particularly adapted for high speed packaging of small articles such as wrapped sticks of gum or a like product. In a high speed machine of the aforedescribed type it is generally desirable that the moving parts be of relatively light weight to reduce inertial and vibrational problems. It is also generally desirable that mechanisms which require abrupt changes in direction and produce violent motions be avoided, since such motions tend to increase the probability of jams and malfunctions. Although gum is characteristically a relatively soft product, when several pieces of gum become jammed in feed mechanism of a packaging machine the gum tends to react as a solid mass which may result in damage to or breakage of machine parts. Accordingly, it is the general aim of the present invention to provide an improved high speed packaging apparatus which advances individual articles, forms the articles in stacks, and forms the stacks in rows with partitions therebetween, while maintaining substantially continuous controlled movement of articles through the machine. It is a further aim of the invention to provide improved high speed machine of the aforedescribed general type which generally avoids utilization of mechanisms which produce abrupt directional changes or relatively violent motions.

SUMMARY OF THE INVENTION

In accordance with the present invention apparatus for forming a package containing stacked articles comprises spiral stacking means for receiving an article at one level and moving the article to another level, means for feeding a succession of articles to the spiral stacking means at said one level, a stacking conveyor having a plurality of stack forming pockets each adapted to contain a stack of articles elevated to said other level by the stacker and for moving the formed stacks away from the stacker. The apparatus further includes a separator conveyor supported in parallel relation to the stacking conveyor for receiving article separators, a first transfer mechanism for moving each successive stack from the stacking conveyor to the separator conveyor, and a second transfer means for moving each successive row of stacked articles from the separator conveyor to a carton set-up station. The spiral stacker includes a pair of axially vertical spaced apart stacking spirals and drive means for rotating the stacking spirals in opposite directions whereby each successive article is elevated to said other level.

BRIEF DESCRIPTION OF PREFERRED EMBODIMENT

Figure 2:
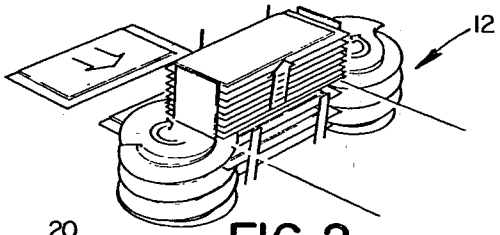
FIG. 2 is a somewhat enlarged fragmentary perspective view of the spiral stacker and stacking conveyor shown in FIG. 1.
Figure 1:
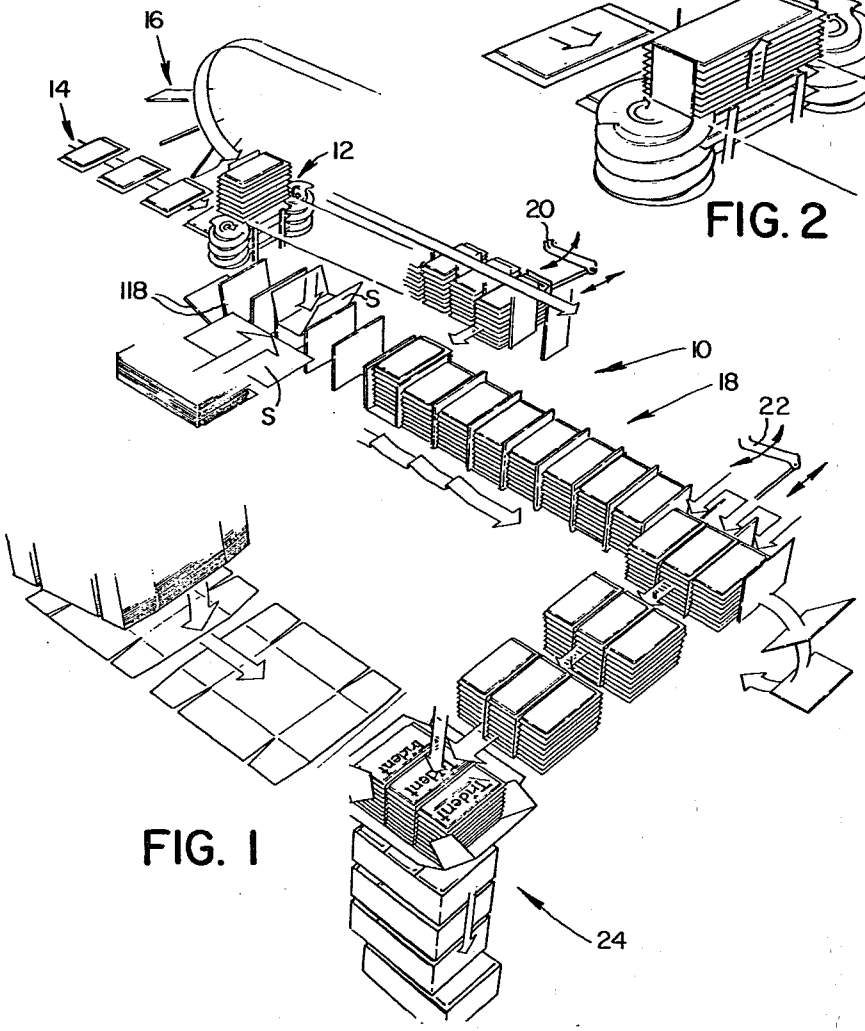
FIG. 1 is a schematic perspective view of a packaging apparatus embodying the present invention.

Turning now to the drawings, a packaging apparatus embodying the present invention is illustrated somewhat schematically and indicated generally by the reference numeral 10 in FIG. 1. The apparatus 10 is particularly suitable for packaging small articles, such as wrapped sticks of gum or the like, and is adapted to receive and stack individual articles, arrange the stacks of articles in rows with separators between adjacent stacks, and feed successive rows to a carton set-up station where a portion of a carton is formed around at least one row of stacked articles. The illustrated apparatus 10 generally comprises a bottom loaded spiral stacker, indicated generally at 12, a loading conveyor, designated generally by the numeral 14, for feeding a succession of individual articles to the stacker in timed relation to operation of the stacker, and a stacking conveyor, indicated generally at 16, positioned above the stacker, for accumulating stacks of articles formed by the spiral stacker and moving the stacks away from the spiral stacker. The illustrated apparatus further includes a separator conveyor, designated generally by the numeral 18, and supported in parallel relation to the stacking conveyor 16, for receiving separators or carton partitions, a first transfer mechanism 20, for moving each successive stack of articles from the stacking conveyor 16 to the separator conveyor 18, and a second transfer mechanism 22 for moving successive rows of stacked articles with separators positioned therebetween from the separator conveyor 18 to a carton set-up station, indicated generally by the numeral 24, where the bottom portion of a two-piece carton is formed around a row or rows of stacked articles to be packaged.

Figure 3:
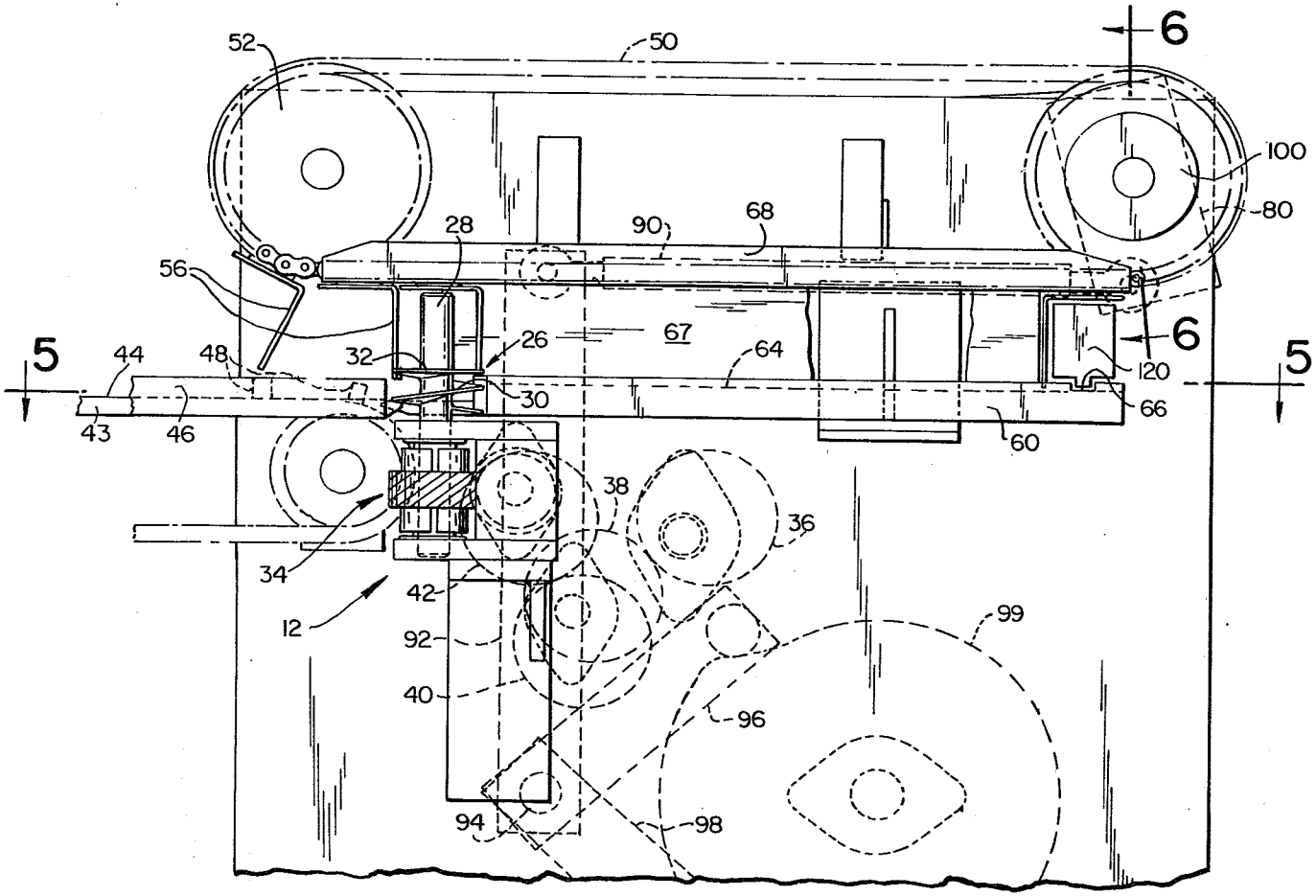
FIG. 3 is a somewhat further enlarged fragmentary front elevational view of the spiral stacker and stacking conveyor.
Figure 8:
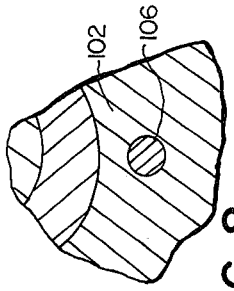
FIG. 8 is a fragmentary sectional view taken along the line 8—8 of FIG. 6.
Figure 4:
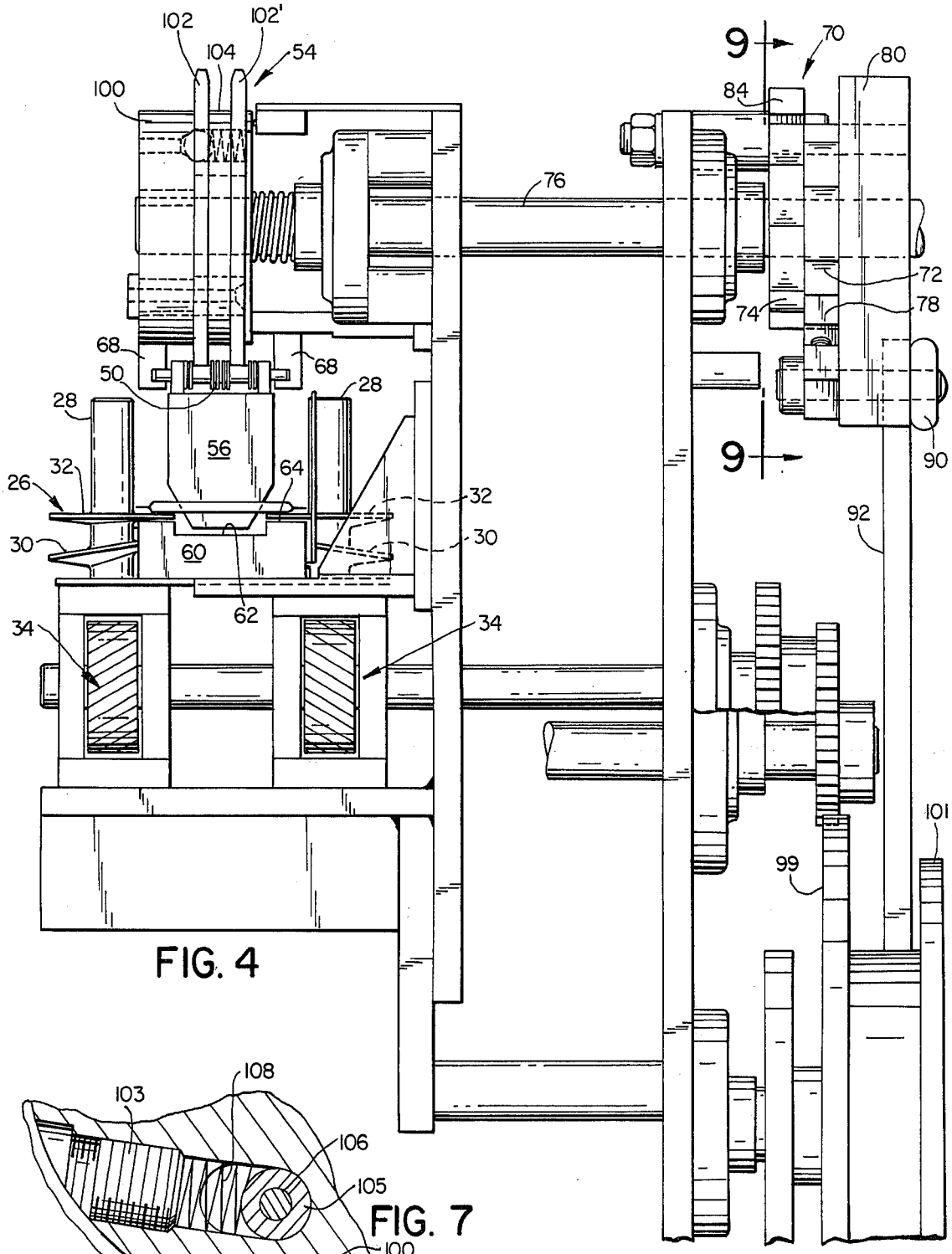
FIG. 4 is a fragmentary right end elevational view of the spiral stacker and stacking conveyor, as shown in FIG. 3.
Figure 5:
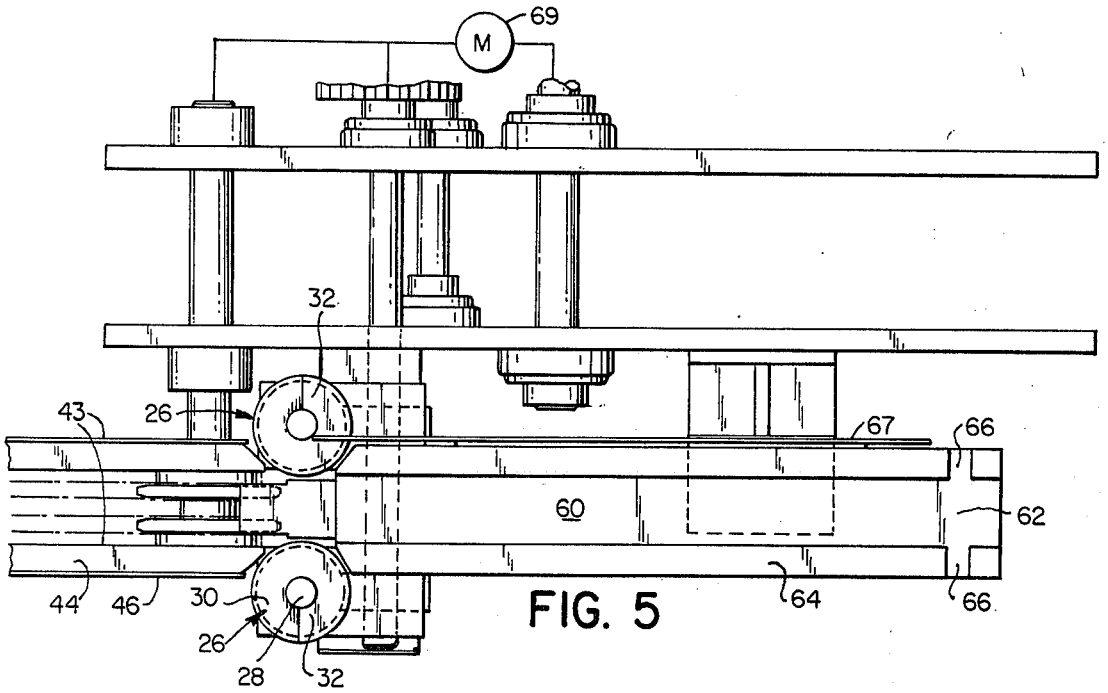
FIG. 5 is a fragmentary sectional view taken generally along the line 5—5 of FIG. 3.

Considering the apparatus 10 in further detail and referring now more particularly to FIGS. 3–5, the spiral stacker 12 includes a pair of transversely spaced apart auger-like stacking spirals, indicated generally at 26, 26, supported for rotation about vertical axes, as best shown in FIG. 4. The stacking spirals 26, 26 are substantially identical but of opposite hand and each has a generally cylindrical vertically disposed shaft 28 and an integral helical track 30 which encircles a central portion of the shaft. Each track 30 terminates at its upper end in a generally semi-annular horizontally disposed and upwardly facing dwell surface 32. The stacking spirals 26, 26 are journalled on the machine frame and driven in unison in opposite directions and in timed relation with the operation of the stacking conveyor 16. The stacking spirals may be operated at constant speed or with an intermittent indexing motion, but preferably, and as shown, the stacking spirals 26, 26 are operated continuously and at varying speed by a gear train which includes a set of helical gears indicated generally at 34, 34 and a plurality of eliptical gears 36, 38, 40 and 42. However, for convenience in illustration, the precise shapes of the eliptical gears are not shown.

As previously noted, articles are fed into the spiral stacker 12 by the loading conveyor 14 which includes a guideway formed by a pair of parallel spaced apart article support members 43, 43 which cooperate to define a horizontal upwardly facing article supporting surface 44, shown in FIG. 3. Side members 46, 46, attached to the outer sides of the support members 43, 43 extend above the surface 44 and form the sides of the guideway which has a transverse width substantially equal to the transverse dimension of an article to be packaged. The loading conveyor 14 further includes a plurality of flight bars 48, 48 mounted on continuous chains supported on sprockets to move within a space between the support members 43, 43 and with the flight bars 48, 48 disposed above the article supporting surface 44, substantially as shown in FIGS. 3 and 5 to advance articles along the article supporting surface and into a lower part of the stacking spirals 26, 26.

The stacking conveyor 16 is supported on the machine frame above the stacker 12 and comprises an endless chain 50 supported on a pair of idler sprockets 52, 52 (one shown in FIG. 3) and a drive or sprocket assembly, indicated generally at 54, best shown in FIGS. 3, 4 and 5. The chain 50 and its supporting sprockets is mounted above the spiral stacker 12 and carries a plurality of generally adjacent L-shaped stack forming pocket members 56, 56 which travel through the space between the stacking spirals 26, 26, as shown in FIG. 4. The stacking conveyor 16 further includes a horizontal carrier bar 60 mounted on the machine frame below the conveyor chain 50. A longitudinally extending and upwardly opening channel 62 formed in the carrier bar 60, as best shown in FIG. 4, receives the free ends of the various pocket elements 56, 56 associated with the lower run of the chain 50, as best shown in FIG. 4. The upper surfaces of the carrier bar 60 cooperate to define a generally horizontally disposed article supporting surface 64 at a level above the article supporting surface 44, but slightly below the dwell surfaces 32, 32. Transversely disposed and upwardly opening notches 66, 66 are formed in the carrier bar 60 near the end remote from the spiral stacker 12, for a purpose which will be hereinafter further discussed. A longitudinally extending fence member 67 is fastened to the rear surface of the carrier bar 60 and extends upwardly from the carrier bar to approximately the height of the lower run of chain 50. The fence member 67 is generally longitudinally aligned with but spaced slightly rearwardly of the rear side member 46, as shown in FIG. 5.

A pair of chain guides 68, 68 mounted on the machine frame above the carrier bar 60 have inwardly opening channels which receive the projecting opposite end portions of pintles on the chain 50 and serve to maintain the lower run of the chain in parallel alignment with the carrier bar 60, so that the free ends of the stack forming pockets 56, 56 track properly within the channel 62. The spiral stacker 12 and the conveyors 14 and 16 operate in timed relation with each other and are preferably driven by a common drive motor 69, shown somewhat schematically in FIG. 5.

Figure 9:
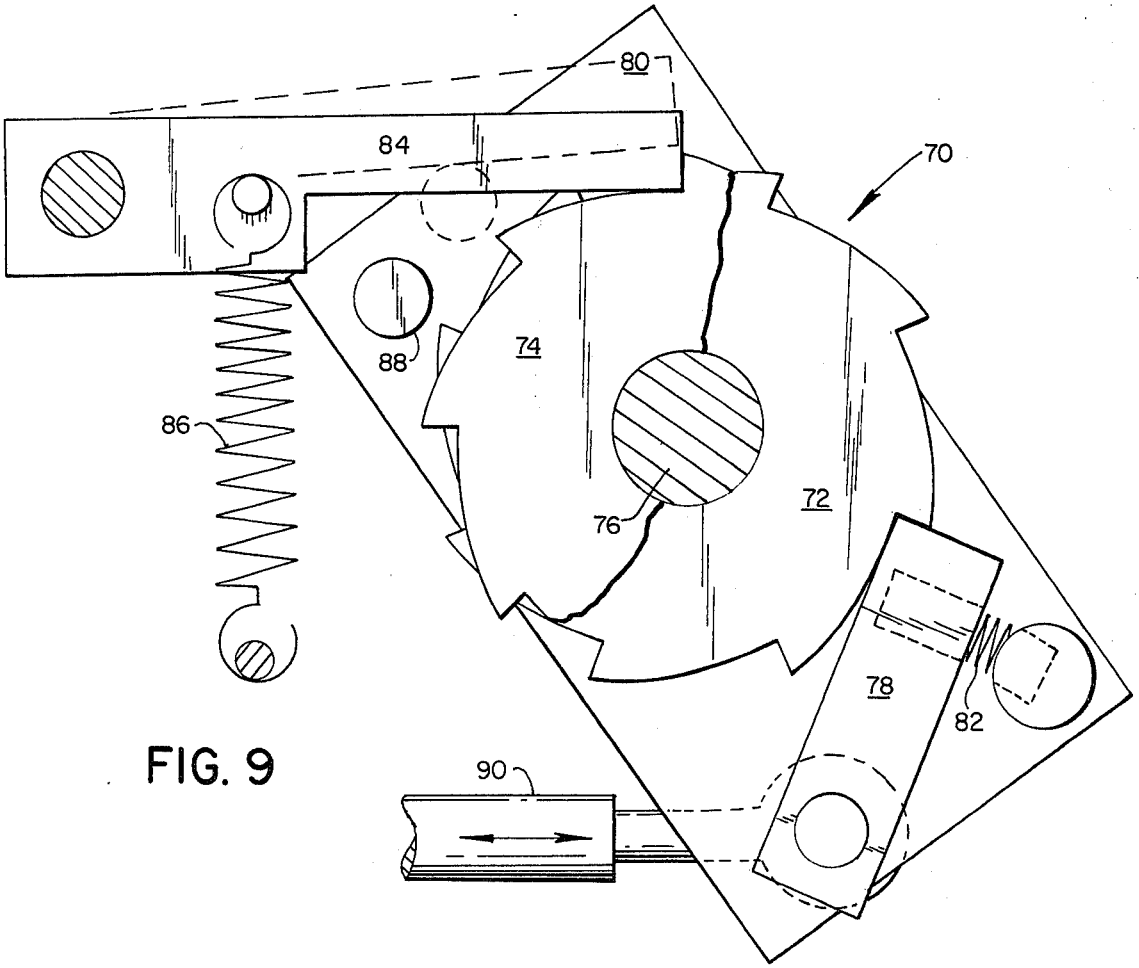
FIG. 9 is a somewhat enlarged sectional view taken along the line 9—9 of FIG. 4.

The conveyor 16 moves with an indexing or intermittent motion and is driven by a ratchet and pawl mechanism indicated generally at 70 and best shown in FIGS. 4 and 9. The mechanism 70 includes a drive ratchet 72 and a stop ratchet 74. The latter ratchets are mounted on a common drive shaft 76 which is journaled on the machine frame and drives the sprocket assembly 54. The ratchets 72 and 74 are mounted in fixed position on the shaft 76 with the teeth of the ratchets facing in opposite directions, substantially as shown in FIG. 9. The pawl which drives the ratchet 72 is designated by the numeral 78 and pivotally mounted on a block 80 which is, in turn, supported to pivot on the shaft 76. A spring 82 acts between the block 80 and pawl 78 to bias the pawl toward driving engagement with the drive ratchet 72. A stop pawl 84 which cooperates with the stop ratchet 74 is pivoted on the machine frame and biased toward the stop ratchet by a spring 86 which acts between the pawl 84 and the machine frame. A pin 88 mounted on the block 80 is arranged to move the stop pawl 84 out of engagement with its associated ratchet, as will be hereinafter further discussed. The ratchet mechanism 70 further includes an adjustable link 90 connected at one end to the block 80 and at its other end to a rock lever 92 mounted in fixed position on a rock shaft 94. A pair of cam levers 96 and 98 are also mounted in fixed position on the rock shaft 94 and carry roller followers which engage conjugate cams 96 and 101 driven by the drive motor to impart a reciprocating motion to the link 90.

Figure 6:
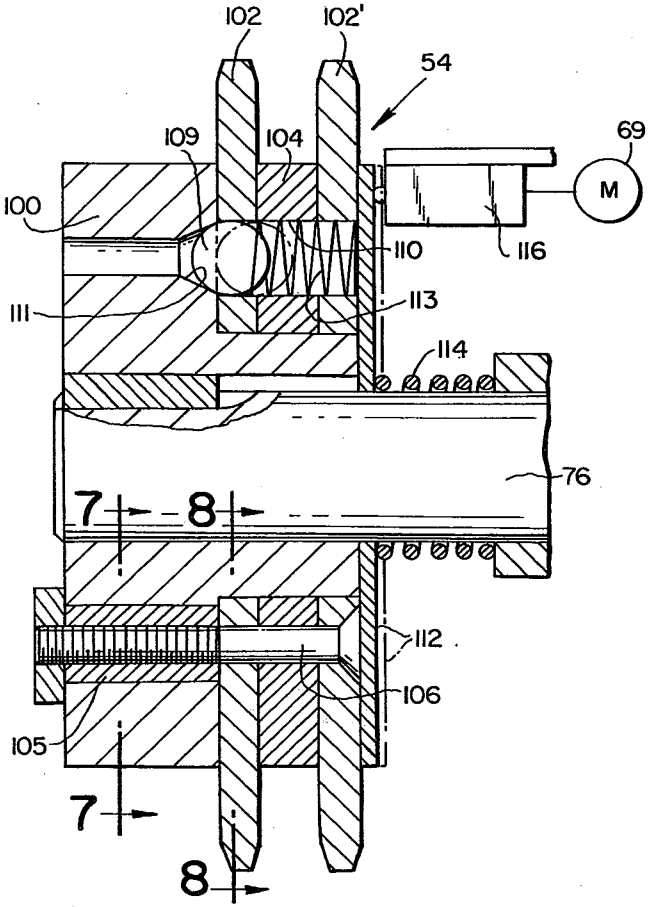
FIG. 6 is a somewhat enlarged fragmentary sectional view taken along the line 6—6 of FIG. 3.
Figure 7:
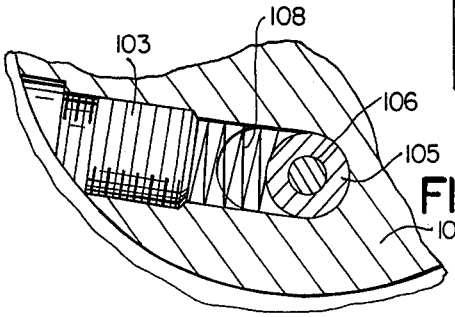
FIG. 7 is a fragmentary sectional view taken along the line 7—7 of FIG. 6.

As previously noted, the stacking conveyor 16 operates intermittently and at high speed in timed relation with the operation of the spiral stacker 12. In order to prevent damage to machine parts upon occurrence of a predetermined condition such as a misfeed or product jam the apparatus includes mechanism for automatically disabling the machine drive to shut-down the machine upon occurrence of such a condition. Specifically, the drive sprocket assembly 54 is driven by a hub 100 keyed to the shaft 76. The hub has a diametrically enlarged outer flange, as shown in FIG. 6. The sprocket assembly 54 includes a pair of rotary drive members or sprockets 102, 102' and a spacer 104 disposed between the sprockets. The sprockets and spacers have cylindrical holes for receiving the hub 100 therethrough and are supported on the hub inwardly of the enlarged hub flange for limited angular movement relative to the shaft 76. Three equiangularly spaced cylindrical drive studs 105, 105 (one shown) which have headed outer ends extend inwardly through slots in the hub flange and are secured in fixed position to the sprockets 102, 102' and the spacers 104, 104 by headed fasteners 106, 106 (one shown in FIG. 6) which extend outwardly through the sprockets and spacers and threadably engage the drive studs. The heads of the fasteners 106, 106 are countersunk below the inner surface of the inner sprocket 102', as best shown in FIG. 6. At least one and preferably three springs 108, 108 (one shown in FIG. 7) received within cavities within the hub flange act between the drive studs 105, 105 and set screws 103, 103 threaded into the hub flange to bias the sprockets 102, 102' and the spacers 104, 104 in counterclockwise direction relative to the hub 100, as it appears in FIG. 3. The springs 108, 108 cooperate with the studs 105, 105 and the fasteners 106, 106 to provide resilient driving connection between the hub and the sprocket assembly. Balls 109, 109 (one shown in FIG. 6) are received in equiangularly spaced bores 110, 110 formed in the sprockets and spacers and in complementary shallow sockets 111, 111 formed in the hub flange. The balls 109, 109 are urged toward the hub flange by stop springs 113, 113 which bear against a circular sensor plate 112 supported on the shaft 76 inwardly of the sprocket 102' and generally adjacent the inner side of the latter sprocket. A plate retainer spring 114 acts between the sensor plate 112 and the machine frame and normally exerts a biasing force on the sensor plate which is somewhat greater than the combined biasing force exerted by the stop springs 113, 113, whereby to urge the sensor plate 112 into adjacent relation with the sprocket 102', as best shown in FIG. 6. The sensor plate 112 is aligned with the actuator of a normally closed switch 116 mounted in fixed position on the machine frame and connected in circuit with the drive motor 69.

The separator conveyor 18, may for example, comprise an endless chain or chains supported on sprockets and which carry a plurality of flight members 118, 118 which cooperate to define stack receiving pockets, such as shown in FIG. 1. A mechanism (not shown) is provided for positioning a separator S above a pocket defined by adjacent flight members 118, 118 and for forcing the separator S downwardly into the pocket to form it to a generally U-shape to complement the pocket, substantially as shown in FIG. 1. In accordance with the illustrated embodiment the separator conveyor 18 and the spacer positioning mechanism operate in timed relation with the stacking conveyor 16 and are or may be driven by the motor 69. The illustrated apparatus positions a separator S in every third stack receiving pocket, as the conveyor 18 advances intermittently in the direction indicated by the arrow in FIG. 1.

The first transfer mechanism 20 comprises a pusher mechanism which includes a pusher plate 120, best shown in FIG. 3 and which is transversely aligned with one of the stacking pockets 56 when the stacking conveyor 16 is at rest, substantially as shown. The pusher plate 120 has a depending tab which is adapted to travel within the slots 66, 66 when the plate is moved transversely of the carrier bar 60 by an associated pushing mechanism (not shown).

The second transfer mechanism 22 is or may be similar to the pusher mechanism 20 aforedescribed but includes a plurality of pusher plates, such as the plate 120 for simultaneously moving a plurality of stacks of articles out of the stack receiving pockets in the conveyor 18 and in the direction of the carton forming station 24. The mechanism 22 may include a further conveyor (not shown) located between the transfer mechanism 22 and the carton set-up station 24 for advancing successive rows of stacked articles to the carton forming station in spaced relation to each other, as shown in FIG. 1. The forming mechanism at the carton forming station 24 is of conventional type and will not be hereinafter further described.

Considering now the operation of the apparatus 10, a succession of articles, which may, for example, comprise wrapped packages of gum or other articles may be received from a wrapping machine (not shown) by the conveyor 14 which feeds the articles to the lower part of the spiral stacker 12. Each article is fed into the stacker at its lower level 44. At the beginning of the stacking cycle the stacking conveyor 16 is at rest with a stacking pocket 56 in an article receiving position immediately above the stacking spirals 26, 26. As previously noted, the stacking spirals 26, 26 are driven in opposite direction and at speeds which vary during each revolution of the spirals. Opposite end portions of the article are engaged by the rotating spirals 26, 26 which elevate the article from its lower level 44 to an upper level defined by the dwell surfaces 32, 32. Upon entering the stacker 12 the article is initially elevated at a high speed, however, the speed of spiral rotation and, consequently, article elevation decreases as the article approaches the upper level 32. When the article reaches the upper level of the stacker the article dwells at that level on the dwell surfaces 32, 32. The next successive article in the stacker continues to be elevated by the stacker, but approaches the article in the dwell position at a reduced speed. As each successive article is elevated by the spiral stacker 12 it moves into engagement with the preceding article thereabove, thereby raising the preceding article within its associated stack forming pocket 56.

When a predetermined number of articles, as, for example, eight articles, have been stacked within the stack forming pocket 56, the conjugate cam mechanism associated with the stacking conveyor 16 causes the conveyor to index, whereby the stack of articles is moved away from the stacking spirals 26, 26 and the next successive stack receiving pocket 56 is moved into its article receiving position above the stacking spirals.

At the beginning of the indexing cycle the drive pawl 78 is at rest on a tooth of the drive ratchet 72 and the stop pawl 84 is engaged with a tooth on the stop ratchet 74, as shown in FIG. 9. Operation of the conjugate cam mechanism rocks the lever 92 in counterclockwise direction causing the block 80 to pivot in clockwise direction. This pivotal movement of the block 80 causes the pin 88, carried by the block, to lift the stop pawl 84 out of holding engagement with the stop ratchet 74 and draws back the drive pawl 78 to a position wherein it is spring biased into driving engagement with an associated tooth on the drive ratchet 72. On the return stroke of the lever 92, as determined by the conjugate cam mechanism, the plate 80 pivots in counterclockwise direction causing the drive pawl to advance the drive ratchet and thereby produce counterclockwise angular movement of the shaft 76 and the hub 100. In FIG. 3 the lever 92 is shown in an intermediate position. The springs 108, 108, the drive studs 105, 105 and the fasteners 106, 106 provide resilient driving connection between the hub 100 and the sprocket assembly 54 to index the conveyor 16. The conveyor indexes while an article is in its dwell mode at the end of an elevating cycle of the spiral stacker 12. Thus, the stacked articles within the pocket 56 may be moved off of the dwell surfaces 32, 32 and onto the slightly lower article supporting surface 64 defined by the carrier bar 60, without substantial risk of jam or interference.

The separator conveyor 18 moves intermittently and in timed relation with the stacking conveyor 16. While the conveyor 18 is at rest a separator S is positioned above an article receiving pocket 118, inserted into the pocket, and formed to a generally U-shape complementing the interior shape of the pocket by an associated separator forming mechanism (not shown). Preferably and as shown in FIG. 1, a separator S is positioned in every third stack receiving pocket of the conveyor 18.

While the stacking conveyor 16 and the separator conveyor 18 are at rest, the transfer mechanism 20 operates to move a stack of articles from the stacking conveyor 16 into an associated stack receiving pocket of the separator conveyor 18. The second transfer mechanism 22 may operate simultaneously to move a row of stacked articles and an associated separator out of the separator conveyor 18 and in the direction of the carton set-up station 24. As shown, each row of articles advanced by the transfer mechanism 22 comprises three stacks of articles, each stack being separated from an adjacent one by a partition defined by the separator S. At the carton forming station 24 the bottom portion of a carton or box is formed around the row of articles. A top portion of the box is added in a later operation (not shown) to complete the package.

The illustrated apparatus 10 is adapted to receive and stack articles at rates up to 400 articles per minute. If each formed stack contains eight articles stacks will be formed at rates up to 50 per minute. Assuming that each carton formed at the set-up station is to contain three stacks of articles, the illustrated apparatus is capable of producing approximately 16.6 packages or cartons per minute.

In the event that a product jam occurs between the spiral stacker 12 and the stacking conveyor 16 the chain 50 will prevent further movement of the drive sprocket assembly 54. However, due to the resilient drive connection between the hub 100 and the sprocket assembly 54, provided by the springs 108, 108, the hub 100 may move slightly relative to the sprocket assembly 54 causing slight compression of the springs 108, 108. This movement of the hub 100 relative to the drive sprocket assembly 54 causes the balls 108, 108 to move out of the shallow sockets 111, 111 in the hub and in the direction of the sensor plate 112. This ball movement causes the springs 110, 110 to exert increased biasing force upon the sensor plate 112 thereby overbalancing the force exerted on the sensor plate by the retaining spring 114 and causing the sensor plate 112 to move to its broken line position of FIG. 6. The sensor plate, in turn, operates the actuator on the switch 116 to move the switch to open circuit condition and thereby shut-down the apparatus 10.

When the condition which caused the machine shutdown has been cleared the sprocket assembly 54 will move angularly relative to the hub 100 under the biasing force of the springs 109, 109 thereby allowing the balls 108, 108 to be received in associated sockets 111, 111 and the sensor plate 112 to return to its normal position adjacent the sprocket 102'. The machine may then be restarted in the usual manner.

We claim:

1. Packaging apparatus for forming a package containing stacked articles and comprising spiral stacking means for receiving an article at one level and moving the article to another level, first drive means for operating said spiral stacking means, means for feeding a succession of articles to said spiral stacking means at said one level, a stacking conveyor having a plurality of stack forming pockets for receiving articles moved to said other level by said spiral stacker, second drive means for intermittently moving said stacking conveyor in timed relation to said spiral stacker to position each successive stack forming pocket in an article receiving position relative to said spiral stacker and for moving each preceding stack forming pocket and a stack of articles contained therein in a direction away from said spiral stacker, a separator conveyor supported in parallel relation to said stacking conveyor for receiving article separators, means for intermittently moving said separator conveyor in timed relation to said stacking conveyor, first transfer means for moving each successive stack from said stacking conveyor to said separator conveyor to form successive rows of stacks on said separator conveyor, and second transfer means for moving successive rows of stacked articles with separators therebetween away from said separator conveyor.

2. Packaging apparatus as set forth in claim 1 wherein said spiral stacking means has a pair of upwardly extending stacking spirals supported for rotation about transversely spaced apart vertical axes and said first drive means comprises means for rotating said stacking spirals in unison and in opposite directions about said axes.

3. Packaging apparatus as set forth in claim 2 wherein said first drive means includes means for varying the speed of rotation of said stacking spirals during each rotation of said stacking spirals.

4. Packaging apparatus as set forth in claim 3 wherein said first drive means comprises a gear train which includes a plurality of eliptical gears.

5. Packaging apparatus as set forth in any one of claims 2, 3 or 4 wherein each of said stacking spirals has a helical track including a radially disposed dwell surface which defines said other level.

6. Packaging apparatus as set forth in any one of claims 2, 3 or 4 wherein said other level is above said one level and said stacking conveyor is supported above said spiral stacker to receive successive articles elevated by said spiral stacker.

7. In a packaging apparatus having a stacking mechanism for receiving an article at one level and moving the article to another level, said stacking mechanism including a pair of upwardly extending stacking spirals supported for rotation about transversely spaced apart vertical axes, and first drive means for continuously rotating said stacking spirals in unison and in opposite directions about said axes, the improvement comprising said first drive means including a gear train having eliptical gears for varying the speed of rotation of said continuously rotating stacking spirals during at least a portion of each rotation of said stacking spirals.

8. In a packaging machine as set forth in claim 7 the further improvement wherein each of said stacking spirals has a helical track terminating in generally radially disposed dwell surface defining said other level.

9. In a packaging apparatus as set forth in claim 8 the further improvement wherein said dwell surface comprises a generally semi-annular surface.

10. In a packaging apparatus as set forth in claim 9 the further improvement wherein each of said stacking spirals has a generally cylindrical portion which extends for some distance beyond said other level and said helical track encircles said cylindrical portion.

11. In a packaging apparatus as set forth in claim 10 the further improvement wherein said other level is above said one level and said stacking conveyor is supported above said spiral stacker.

12. In a packaging apparatus as set forth in claim 7 the further improvement wherein said first and second drive means are driven by a common drive motor and apparatus includes means for automatically disabling said drive motor in response to occurrence of a predetermined condition within said apparatus.

13. In a packaging apparatus as set forth in claim 7 the further improvement wherein one of said drive means includes a drive shaft driven by said drive motor, a hub mounted on said shaft, a rotary drive assembly supported on said shaft for limited angular movement relative to said hub, connecting means for drivingly connecting said rotary drive assembly to said hub, and said means for disabling said drive motor comprises means for disabling said drive motor in response to angular movement of said hub relative to said rotary drive assembly.

14. In a packaging apparatus as set forth in claim 13 the further improvement wherein said means for disabling said drive motor includes a sensor plate mounted on said shaft for axial movement between first and second positions relative to said rotary drive assembly, an electrical switch electrically connected to said drive motor and having an actuator operated by movement of said sensor plate toward said second position, and means for moving said sensor plate toward said second position in response to angular movement of said hub relative to said rotary drive assembly.

15. In a packaging machine as set forth in claim 14 the further improvement wherein said means for moving said sensor plate includes at least one ball carried by said rotary drive assembly and partially disposed within a socket in said hub and one spring acting between said ball and said sensor plate and means normally biasing said sensor plate toward its first position.

16. In a packaging machine as set forth in any one of claims 13 through 15 wherein said one drive means comprises said second drive means.

17. In a packaging apparatus as set forth in any one of claims 13 through 15 the further improvement wherein said connecting means is further defined as a resilient connecting means.

18. In a packaging apparatus as set forth in claim 17 the further improvement wherein said resilient connecting means comprises a spring disposed within a recess in said hub and bearing upon a fastener securing said rotary drive assembly in assembled relation to said hub.

19. In a packaging apparatus having stacking means for receiving an article at one level and moving the article to another level, first drive means for operating said stacking means, conveying means for receiving a stack of articles formed by said stacking means and for moving the stack away from the stacking means, second drive means for operating said conveying means in timed relation with the operation of said stacking means, a drive motor for operating said first and second drive means, and disabling means for automatically interrupting power to said drive motor in response to the occurrence of an overload condition within said apparatus, the improvement wherein one of said drive means includes a drive shaft driven by said motor, a hub mounted on and driven by said drive shaft, at least one rotary drive member mounted on said shaft for limited angular movement about the axis of said shaft and relative to said hub, connecting means for drivingly connecting said rotary drive member to said hub to rotate with said hub, and said disabling means includes a sensor plate mounted on said shaft generally adjacent said rotary drive member for axial movement relative to said shaft between first and second positions, an electrical switch electrically connected to the drive motor and having an actuator in the path of movement of said sensor plate between its first and second position, and means for moving said sensor plate toward its second position in response to angular movement of said hub relative to said rotary drive member.

20. In a machine as set forth in claim 19 the further improvement wherein said means for moving said sensor plate includes at least one ball carried by said drive member and partially disposed within a socket in said hub, said one ball being movable out of said socket and into said drive member in response to angular movement of said hub relative to said drive member, and a spring carried by said drive member and acting between said one ball and said sensor plate.

21. In a machine as set forth in claim 20 the further improvement wherein said connecting means comprises at least one spring acting between said hub and said drive member.

22. Packaging apparatus for forming a package containing stacked articles and comprising spiral stacking means for receiving an article at one level and moving the article to another level, first drive means for operating said spiral stacking means, means for feeding a succession of articles to said spiral stacking means at said one level, a stacking conveyor having a plurality of stack forming pockets for receiving articles moved to said other level by said spiral stacker, second drive means for intermittently moving said stacking conveyor in timed relation to said spiral stacker to position each successive stack forming pocket in an article receiving position relative to said spiral stacker and for moving each preceding stack forming pocket and a stack of articles contained therein in a direction away from said spiral stacker, a separator conveyor for receiving article separators, means for intermittently moving said separator conveyor in timed relation to said stacking conveyor, first transfer means for moving each successive stack from said stacking conveyor to said separator conveyor to form successive rows of stacks on said separator conveyor with separators therebetween, and second transfer means for moving successive rows of stacked articles with separators therebetween away from said separator conveyor.

23. In a packaging apparatus having a stacking mechanism for receiving an article at one level and moving the article to another level, said stacking mechanism including a pair of upwardly extending stacking spirals supported for rotation about transversely spaced apart axes, and first drive means for continuously rotating said stacking spirals in unison about said axes, the improvement comprising said first drive means including a gear train having eliptical gears for varying the speed of rotation of said continuously rotating stacking spirals during at least a portion of each rotation of said stacking spirals.

* * * * *